US005743056A

United States Patent [19]

Balla-Goddard et al.

[11] Patent Number: 5,743,056

[45] Date of Patent: Apr. 28, 1998

[54] BUILDING PANEL AND BUILDINGS MADE THEREFROM

[76] Inventors: Michael Steven Andrew Balla-Goddard, TYN Yr Erw. clawddnewyyd, Ruthin, Clwyd LL25 2NP; Andrew Francis Denny, 5 West View Drive, Myndd Isa, Mold, Clwyd; Philip Godfrey Harrison, 2 Gostella Cottages, Gostella, Dodleston, Nr. Chestor CH4 9LL, all of United Kingdom

[21] Appl. No.: 476,446

[22] Filed: Jun. 7, 1995

Related U.S. Application Data

[63] Continuation of PCT/GB93/00758 Apr. 8, 1993.

[30] Foreign Application Priority Data

Oct. 4, 1992 [GB] United Kingdom ..... 92080159
Aug. 4, 1993 [GB] United Kingdom .... PCT/GB93/00758

[51] Int. Cl.[6] ..... E04C 2/26

[52] U.S. Cl. ..... 52/309.11; 52/127.9; 52/293.3; 52/309.7; 52/309.8; 52/309.16; 52/405.3; 52/582.2; 52/794.1; 52/796.1; 52/797.1; 52/801.11

[58] Field of Search ..... 52/127.9, 293.1, 52/293.3, 309.4, 309.7, 309.8, 309.9, 309.11, 309.12, 309.13, 309.14, 309.16, 309.17, 405.1, 405.2, 405.3, 405.4, 580, 582.2, 589.1, 590.2, 783.1, 794.1, 793.11, 796.1, 797.1, 801.11

[56] References Cited

U.S. PATENT DOCUMENTS

| | | | |
|---|---|---|---|
| 2,054,694 | 9/1936 | Eldredge | 52/793.11 |
| 2,131,268 | 9/1938 | Boes . | |
| 2,336,435 | 12/1943 | Zirinsky | 52/293.1 X |

(List continued on next page.)

FOREIGN PATENT DOCUMENTS

| | | | |
|---|---|---|---|
| 2652109 | 3/1991 | France | 52/794.1 |
| 33 159 01 | 11/1984 | Germany . | |
| 53-23114 | 3/1978 | Japan | 52/309.4 |
| 89/11573 | 11/1989 | WIPO . | |

OTHER PUBLICATIONS

"Saving Time & Money With TMC Building Systems", Reprinted from Apr. 1992 issue of BUILDER Magazine, Hanley–Wood, Inc.

"The Builder's Edge", TMC Building Systems, Jan. 1992.

"Murus Home Shell Packages", The Murus Company, Blueprints, prices, materials, list, specs and technical information.

"Insulated Modular Building Panels", Retan Developments.

"Flexible Design Potential for a Wide Range of Fast–Build, Low–Cost Insulated Buildings Anywhere in the World", Hemsec System Build, Hemsec Installations Limited.

"Blockbuster", Professional Builder Jul./Aug. 1993, pp. 20–21.

"Cold forming hot on the heels of timber", Housing Construction News, Aug. 19, 1993, p. 21.

"Surebuild sure of itself", Construction News, Aug. 19, 1993, p. 21.

*Primary Examiner*—Wynn E. Wood
*Assistant Examiner*—Laura A. Callo
*Attorney, Agent, or Firm*—Helfgott & Karas, P C.

[57] ABSTRACT

A rectilinear composite building panel having a pair of opposed faces, and a pair of opposed sides, the panel comprising a pair of spaced-apart rigid face sheets (56), a rigid insulating material (58) sandwiched between, and adhering to, the face sheets, connecting means (60) connecting the face sheets together to resist relative movement between the face sheets in the plane of the panel and out of the plane of the panel; the opposed sides (66,70) each have a profiled shape for mating with a correspondingly profiled side of an adjacent panel; each side (66,70) has means (72,74) for securing, or being secured to, a side of an adjacent panel of the same general construction. The panels can be easily assembled together to form a fire-resistant multi-story building.

16 Claims, 7 Drawing Sheets

U.S. PATENT DOCUMENTS

| | | | |
|---|---|---|---|
| 2,953,873 | 9/1960 | Tatro | 52/293.3 X |
| 3,203,145 | 8/1965 | Raynes | 52/293.1 X |
| 3,280,522 | 10/1966 | Palfrey et al. | 52/127.9 |
| 3,313,073 | 4/1967 | Mathews | 52/309.11 X |
| 3,365,851 | 1/1968 | Cushman | 52/580 |
| 3,400,958 | 9/1968 | Haimes et al. | 52/127.9 |
| 3,665,662 | 5/1972 | Timbrook et al. | 52/239.1 X |
| 3,785,103 | 1/1974 | Turner | 52/309.11 |
| 4,078,348 | 3/1978 | Rothman | 52/309.7 |
| 4,290,246 | 9/1981 | Hilsey | 52/293.1 X |
| 4,712,352 | 12/1987 | Low . | |
| 4,936,069 | 6/1990 | Hunter et al. | 52/309.4 |
| 4,941,304 | 7/1990 | Lewellin | 52/580 |
| 4,981,003 | 1/1991 | McCarthy | 52/309.7 |
| 5,072,569 | 12/1991 | VanTassel | 52/309.7 X |
| 5,081,810 | 1/1992 | Emmert | 52/580 X |
| 5,269,109 | 12/1993 | Gulur | 52/309.7 X |
| 5,424,118 | 6/1995 | McLaughlin | 52/589.1 X |
| 5,477,652 | 12/1995 | Torrey et al. | 52/309.13 |
| 5,497,589 | 3/1996 | Porter | 52/309.7 |
| 5,502,931 | 4/1996 | Munir | 52/144 |

BUILDING PANEL AND BUILDINGS MADE THEREFROM

CROSS-REFERENCE TO RELATED APPLICATION

This is a continuation of international application PCT/GB93/00758, filed 08 Apr. 1993, which designated the United States and is now abandoned.

TECHNICAL FIELD

The present invention relates to buildings and in particular to a building panel for use in constructing buildings.

BACKGROUND ART

There is throughout the world a need for dwellings and other buildings that can be rapidly and cheaply constructed and there have been many proposals for constructing such buildings. However, generally, the quality of such buildings has been low and/or such buildings have not been as simple to construct as would be desirable.

It is well known to construct buildings by erecting a rigid structural framework, for example of steel girders, and to bolt prefabricated panels between the girders to provide the desired outer and inner walls. However, such buildings are expensive and time-consuming to erect. Alternatively, it is known to erect buildings and enclosures out of prefabricated load-bearing panels that are connected together to provide the desired outer walls of the buildings. However, buildings made in this way are not acceptable as dwelling because they do not meet the requirements of fire-resistance. The problem of making fire-resistant prefabricated panels is complicated if they bear substantial loads since the load tends to accelerate the disintegration of a panel when subject to fire.

It is also known to make building panels out of concrete containing a layer of insulating material. However such panels are heavy and difficult to transport and do not have good insulating properties. Also the insulation does not adhere to the concrete and so the panel is not a composite structure.

DISCLOSURE OF THE INVENTION

According to the present invention, there is provided a rectilinear composite loadbearing building panel having a pair of opposed faces and a pair of opposed sides, the panel comprising a pair of spaced-apart rigid face sheets, rigid insulating material sandwiched between, and adhering to, the face sheets, connecting means, which are preferably intermediate between the opposed sides, connecting the face sheets together to resist any relative movement between the face sheets both in the plane of the panel and out of the plane of the panel and wherein the opposed sides each have a profiled shape for mating with a correspondingly profiled side of an adjacent panel and wherein the sides have means for securing them to sides of adjacent panels.

As used herein, the term "load-bearing panel" means a panel capable of withstanding compressive forces between the top and the bottom surfaces of at least 5 kN/m and preferably at least 10 kN/m: generally we aim at providing a panel capable of withstanding a compressive force of about 20 to 30 kN/m.

It is emphasized that the panel of the present invention is composite in nature, that is to say the face sheets adhere to, and therefore interact with, the insulating material to produce a panel having composite strength greater than that of the individual parts. This is to be distinguished from known case concrete building panels that includes an internal layer of insulating material since there is no structural interaction between the insulating material and the concrete and so such a panel acts as a laminar body and not a composite body. During a fire the pans of the panel of the present invention also interact; for example the insulating material isolates the connecting member from the high temperature of the fire while the connecting member prevents the face sheet next to the fire from buckling under the effect of the fire, thereby isolating the insulating material from the fire and also maintaining the structural integrity of the panel.

The face sheets are rigid boards (for example particle boards, cement particle boards, glass fibre reinforced cement boards, cellulose reinforced gypsum boards, crushed slate boards and resin boards; suitable boards are available under the trade names SUPALUX™, MONOLUX™, PANELCRETE™, VIROC™, and PYROC™); it is advantageous that the boards can take and retain fixings, for example nails, screws or staples; also the boards are preferably capable of being bonded to other panels or to other building elements or items by adhesive or foam injection. In addition to the abovementioned materials, the face sheets can be made of wood, plastics material or metal. The face sheets are preferably thermally insulating and should not be made of readily combustible material. The face sheets may be treated with a fire-retardant paint to enhance the fire resistance of the panel, or may have a fire-retardant added to its composition.

The insulating material may be a rigid organic or foam, for example a foamed polyurethane. The panel is preferably made by foaming a polymer in situ between the face sheets and the materials used are advantageously such that the foam adheres directly to the board naturally so that no adhesive is required between the foam and the face sheets (as is the case of cement particle board and the polyurethane). In addition to any natural bond between the insulating material and the face sheets, the insulating material and the face sheets may be joined, e.g. by adhesive.

The connecting means is preferably heat- and fire-resistant and it is most preferably metallic, although other materials, e.g. steel carbon fibre, fibre glass, glass, plastics, impregnated board or laminated timber, may be used. The connector must provide rigid connection between the face sheets that resists relative displacement of the face sheets both within the plane of the panel and out of the plane of the panel. The connector means is preferably elongate and more preferably vertically disposed within the panel. More particularly, the connecting means may be a stud of an "T", "IC" or "Z" shaped-section: it may be solid, hollow, or of box or honeycomb construction. It need not be straight and, when viewed face-on, may be of "Z", "C", undulating, castellated or zig-zag shape. The connecting means plays an important function in maintaining the strength of the panel in the case of fire. It not only prevents the face-sheet delaminating from the insulating material, but also connects the two face sheets and so maintains the structural integrity of the panel which thus retains its composite structure and composite properties. Each panel may include more than one connecting member, the number of members in each panel depending on the size and the shape of the members, and the size of the panel. When the connecting means is in the form of a stud, there would generally be one, two or three such members. The connecting members may include openings either in the members themselves (by providing holes in the members) or between the members and the face sheets (for example by making the sides of the members abutting the face sheets as a castellated configuration) to assist the even distribution of foam to the panel.

The connecting means may themselves provide secondary load-bearing capacity, i.e. when the load-bearing capacity of a composite panel as a whole is somehow impaired, e.g. through fire. When this is the case, the connecting means can extend vertically from the top to the bottom of the panel but may be in some other structural configuration.

The profiled shape of the opposed sides will generally be of complementary male/female shape, thus the profiles may be of intermeshing toothed shape (e.g. rectangular or triangular teeth), wavy shape or tongue-and-groove shape. The profile may include an intumescent material, e.g. the tongue and/or the groove in a tongue-and-groove profile may be made of intumescent material, to provide additional sealing action in the case of fire. Furthermore, the opposed sides may be made of or include resilient material to provide an air-tight seal when adjacent panels are joined together.

The means of securing panels together should not only connect the adjacent panels together but also draw them together to make an air-tight seal. The securing means is preferably a lock fitted in the side of one panel that can engage a corresponding member in an adjacent panel to secure the two panels together. Particularly preferred are camaction locks which are customarily used for securing together cladding panels used on the outside of buildings. These locks not only engage adjacent members but also pull them together when appropriately fitted. Such locks are known in the building industry, for example type 1172 or 1175 panel fasteners manufactured by Kason Hardware (UK) Limited of Bilston, West Midlands, United Kingdom. Alternatively,, the lock may be any other type of fixing, such as a tapered bolt or a screw connector that draws the panels together to form an airtight seal between adjacent panels.

The main benefit of the building panel of the present invention is that it can be used to construct a building cheaply and simply without having to provide a structural frame.

According to a second aspect of the present invention, there is provided a building comprising a foundation, a plurality of walls enclosing a space within the building, the walls being formed partly or wholly from panels as defined above whose opposed sides are secured together, means secured to the foundation for holding the bases of the panels, means for holding the tops of the panels and a roof structure supported on the walls, wherein the walls made of the said panels form the, or part of the, structural frame of the building.

The joints between adjacent panels are the parts most prone to damage by fire. They are preferably protected in use by a layer of fire-resistant material, e.g. plasterboard. The use of a plasterboard cladding over the whole of the inner face of a wall made out of panels of the present invention also improves the decorative finish of the room. A vapor barrier may be included between the plasterboard and the panel that, in the case of fire, assists in keeping water vapor within the room where it assists in damping the fire.

The panels may also be connected together to form other building elements, for example floors and ceilings and roofing panels. In the latter case, the panels could be supported by trusses and/or purlins and would avoid the need to provide rafters. When used as a roof, the panels should have a weatherproof outer surface, e.g. a covering of tiles or roofing felt.

The building can be single-story or multi-story and in the latter case, each story is preferably formed by a row of panels as described above.

As indicated, the building panels can be incorporated into a building in which a number of different materials are used to form, not only the roof and the floors, but also the walls of the building. Thus, for example, in a cavity construction, only one skin of the outer wall of the building may be made of the above-described building panels, the other skin being made of traditional materials such as brick, breeze-blocks, etc.; in such a construction, the panels will form at least part of the load-bearing part of the wall.

These floors can be a variety of different materials such as timber in cassette form, precast concrete or lightweight concrete poured into a pressed metal form, or a pressed metal deck and pressed metal beams.

The means for holding the bases and the tops of the panels are each preferably of channel shape, the channel fitting onto the bottom or top (respectively) of the panels. The channels may extend merely over the joint between adjacent panels but are more preferably of greater length extending over at least two (and preferably more) panels.

A damaged panel can be replaced relatively simply by stripping off any internal fire-resistant material to reveal the damaged panel, undoing the securing means and cutting out or lifting out the damaged panel. One or more new panel(s) may then be inserted into the wall in its place; the channeling holding the top and bottom of the original damaged panel will often have to be replaced too.

One advantage of the present invention is that it is possible to provide a complete building in kit form that can be readily transported to a site and erected quickly; this has obvious applications in disaster relief but it also finds general application in the provision of cheap housing of good quality.

According to a third aspect of the present invention, there is provided a kit for forming a building as defined above, the kit comprising a plurality of panels as defined above, that can be secured together to form walls, means (e.g, foot plates) for securing to the foundation of a building for holding the bases of the panels, means (e.g. head plates) for holding the tops of the panels and a roof structure.

BRIEF DESCRIPTION OF THE DRAWINGS

The invention will be described in further detail by reference to the accompanying drawings, in which.

BEST MODE FOR CARRYING OUT THE INVENTION

Figure 1:
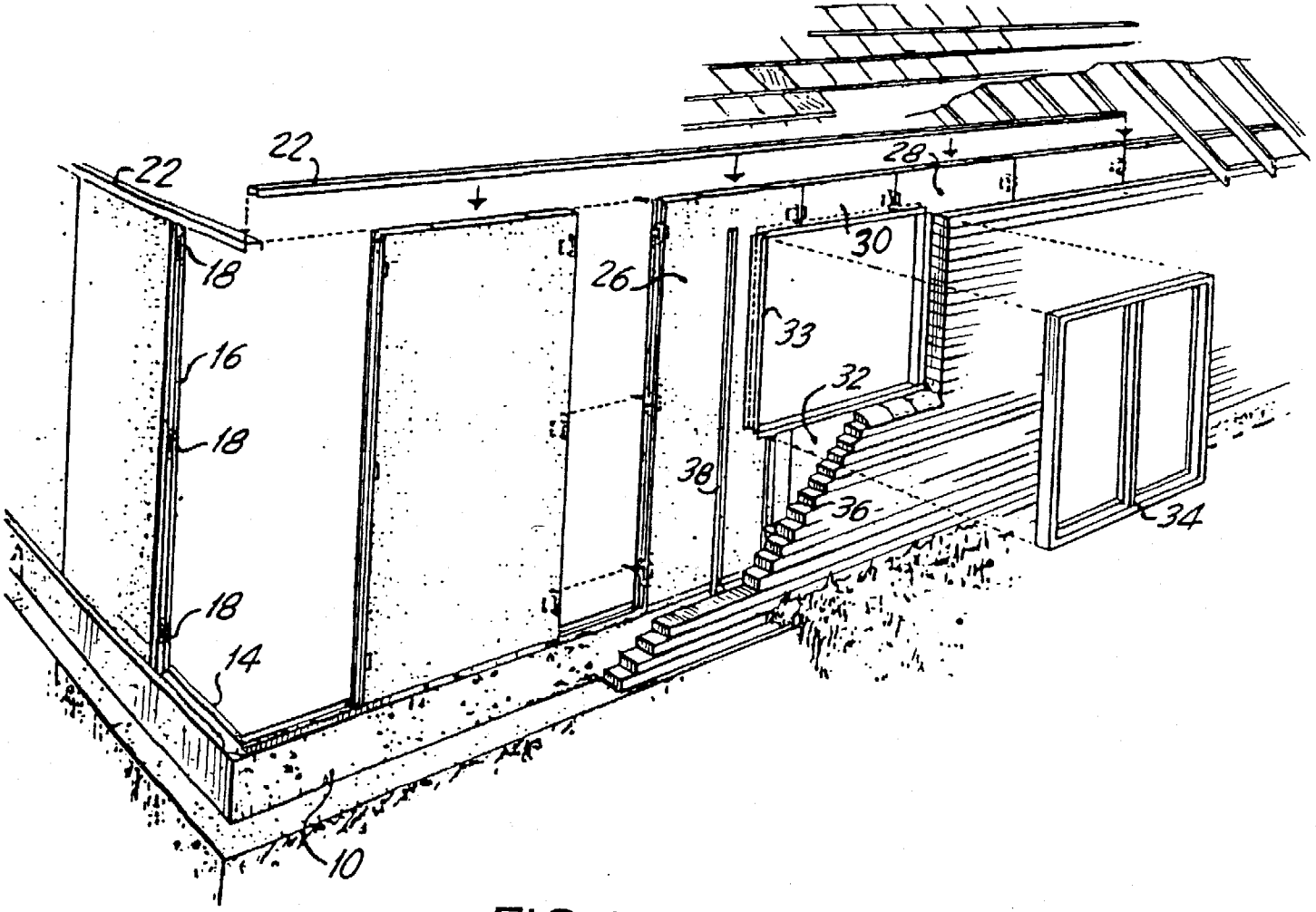
FIG. 1 is an isometric view of a building that is partly constructed.

Referring initially to FIG. 1, there is shown a partly constructed building using panels of the present invention.

Figure 2:
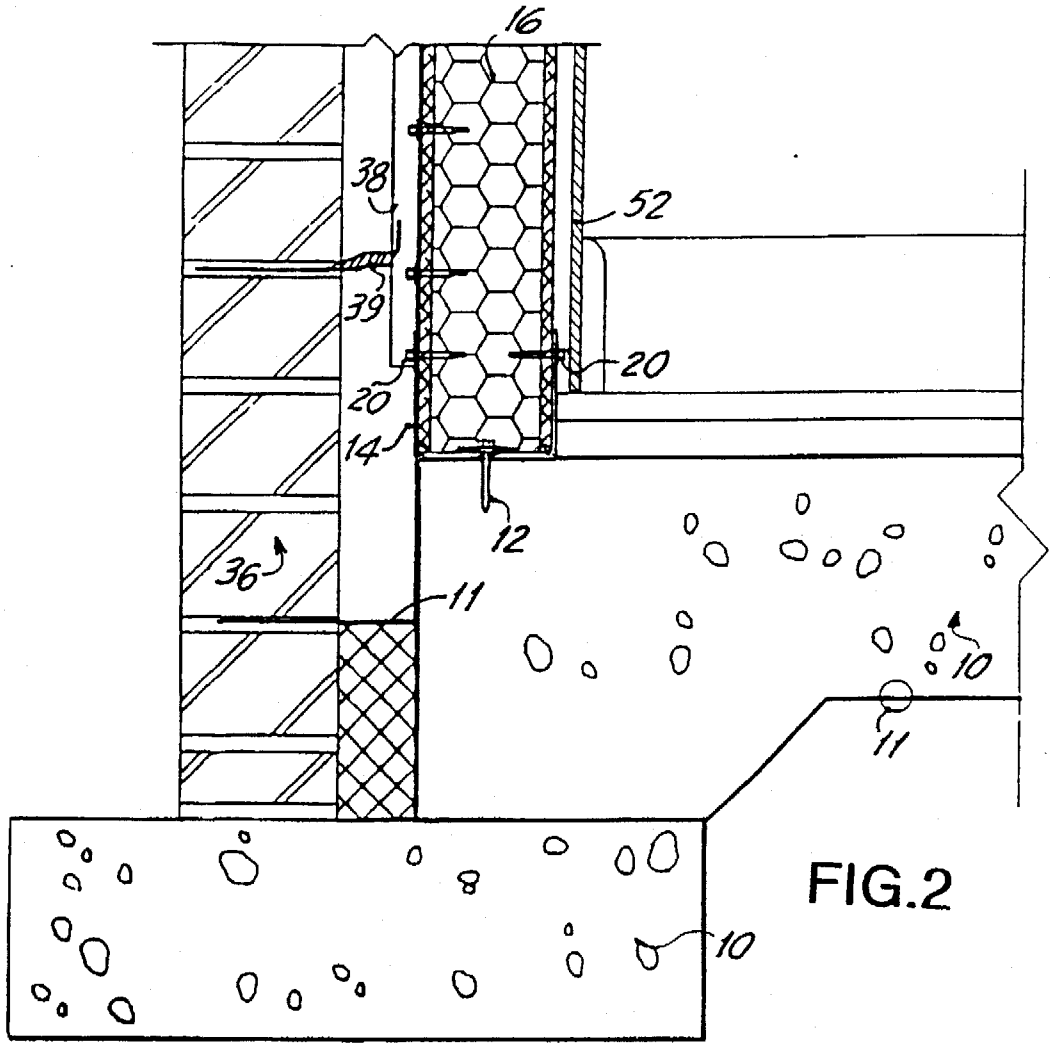
FIG. 2 is a vertical section though the base of a wall showing also the foundations.

The building consists of foundations 10 to which are secured by means of bolts 12 (see FIG. 2) foot plates in the form of lengths of galvanized steel channelling 14, the channelling extending along the whole length of the building. Panels 16 are fitted into the channelling. Adjacent panels are secured to one another by locks 18 which will be described in further detail below. Once the panels have been secured together by the locks, they are secured to the channelling by means of screws 20 (see FIG. 2) and in this way a wall can be quickly and easily constructed, head plate 22 in the form of a channel are placed over the panels and secured thereto by screws 24 (see FIG. 3), passing through the sides of the channel 22 into the panels 16. Once the outer walls of the building have been constructed, standard roofing trusses may be secured to the walls using standard building techniques and subsequently standard roofing felt and roofing materials are applied to finish the building.

Figure 4:
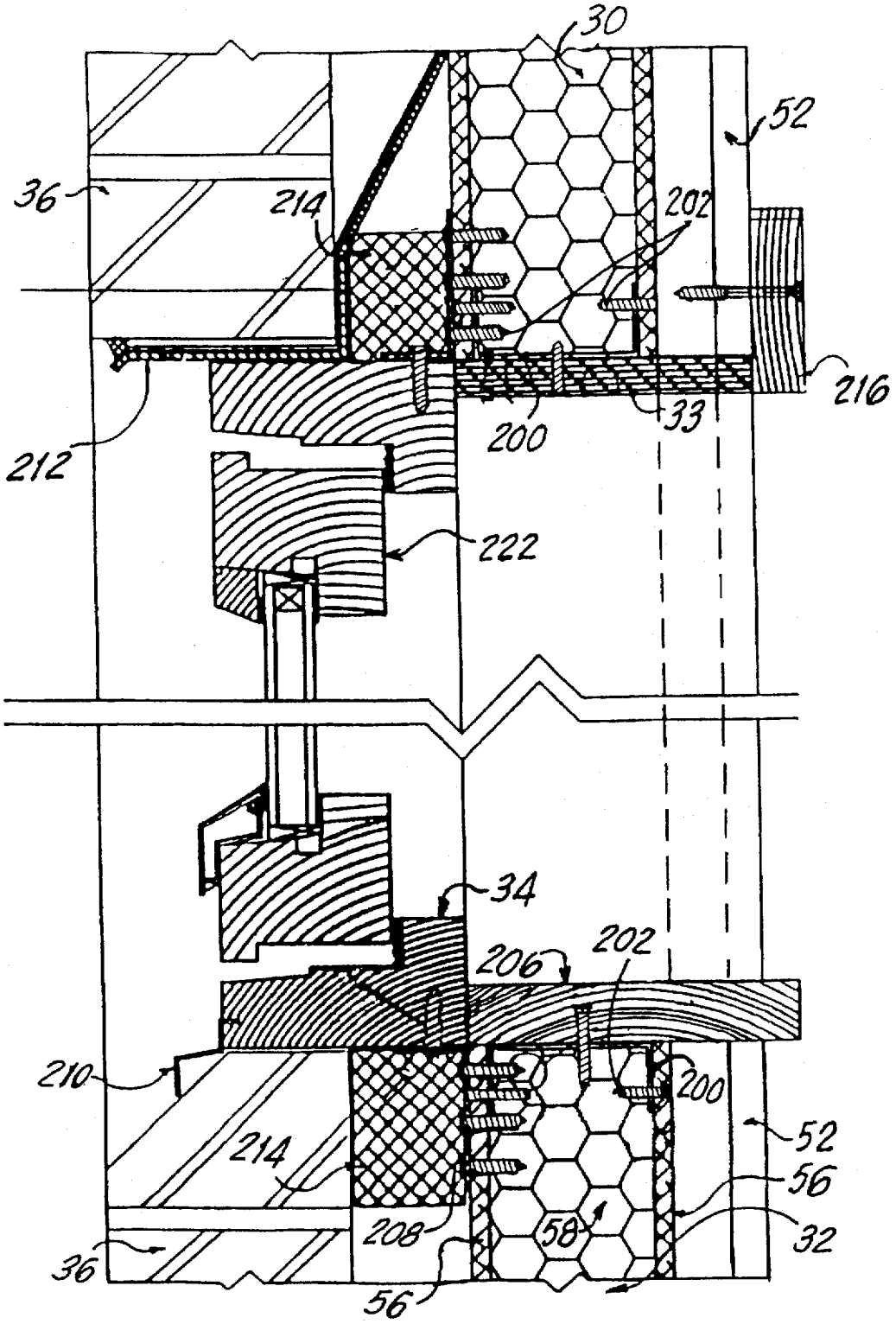
FIG. 4 is a vertical sectional view through a window.

Windows and doors may be formed by joining adjacent panels 26, 28 by short, narrow panel parts 30, 32 that are joined to panels 26, 28 by standard locks 18. The panel parts 30, 32 contain no connecting members. A section of the two adjacent panels 26, 28 is then cut out, as shown in FIG. 1, and a length of plasterboard 33 secured around the perimeter of the window opening except for the lower surface, where a sillboard is secured. A window frame 34 may be then secured in the opening. Doors may be constructed in a similar way but in this case, bottom panel 32 is omitted. A detailed view of a window opening is shown in FIG. 4, which is described below.

In order to improve the appearance of the building, a cladding of bricks 36 may be provided, which is secured to the panels 16 by wall ties 39 (see FIG. 9) slidable in channelling 38 that in turn is screwed to the outside of panels 16. Other facings such as stone or wood may be used instead of the brick. Alternatively, the outsides of the panels may be left unclad.

One advantage of using cement particle board in forming the panels of the present invention is that it is completely inert and water-proof and requires no further conditioning to prevent its deterioration from weather conditions or to render it waterproof. In particular, a damp-proof course may not be required since the foot plate acts also as a damp-proof course. If a separate damp-proof course is required, this can be achieved by applying a liquid water-proofing product to a concrete base and a continuous membrane 11 (see FIG. 2) being laid over this (a Hiload polymer d.p.c. is suitable for the membrane). If the base is made of brick, only a membrane is required. An expanding self-adhesive cellular foam strip or mastic sealant can be applied to the front and rear sides of the channelling 14 to prevent water coming into contact with the base of the panel and to accommodate any irregularities in the surface of the concrete.

Water-proof jointing of the channel sections 14 is achieved using mastic sealants; also channel sections 14 are laid in such a way that the joints in the channel sections do not correspond with vertical panel joints so that moisture cannot enter the panels through a joint in the channel sections.

As can be seen in FIG. 1, foot and head plate channels 14 and 22 extend over the width of several panels 16; this has the advantage that if the foundations are not exactly smooth or if they are not exactly level, the foot plate channels 14 can be placed on the foundations and, if necessary, packing may also be provided below the channels so that the channels are horizontal. In this way, a horizontal surface is provided for the panels 16. The head plate channel 22 distributes the load of the roof or intermediate floors, if any, over several panels and thereby prevents one panel from becoming unduly stressed; this is particularly important when providing openings for doors an windows since the force exerted by the roof or the intermediate floor(s) on panel 30 above the window shown in FIG. 1 is distributed over adjacent wall panels 26, 18. Indeed, it is preferred to include an additional lintel over each window or door, the lintel being a further lintel channel section that overlies the top of the panel above the window or door opening and extends over the panel immediately adjacent to the opening by a distance of approximately 300 mm on each side.

A sealant is applied to the exterior joints of the panels either where they are decorated as a stand alone product or where they form the internal skin of a cavity construction. The nature of the sealant will depend on the environment in which the building is situated, the construction of the building and the decorative products used.

Figure 3:
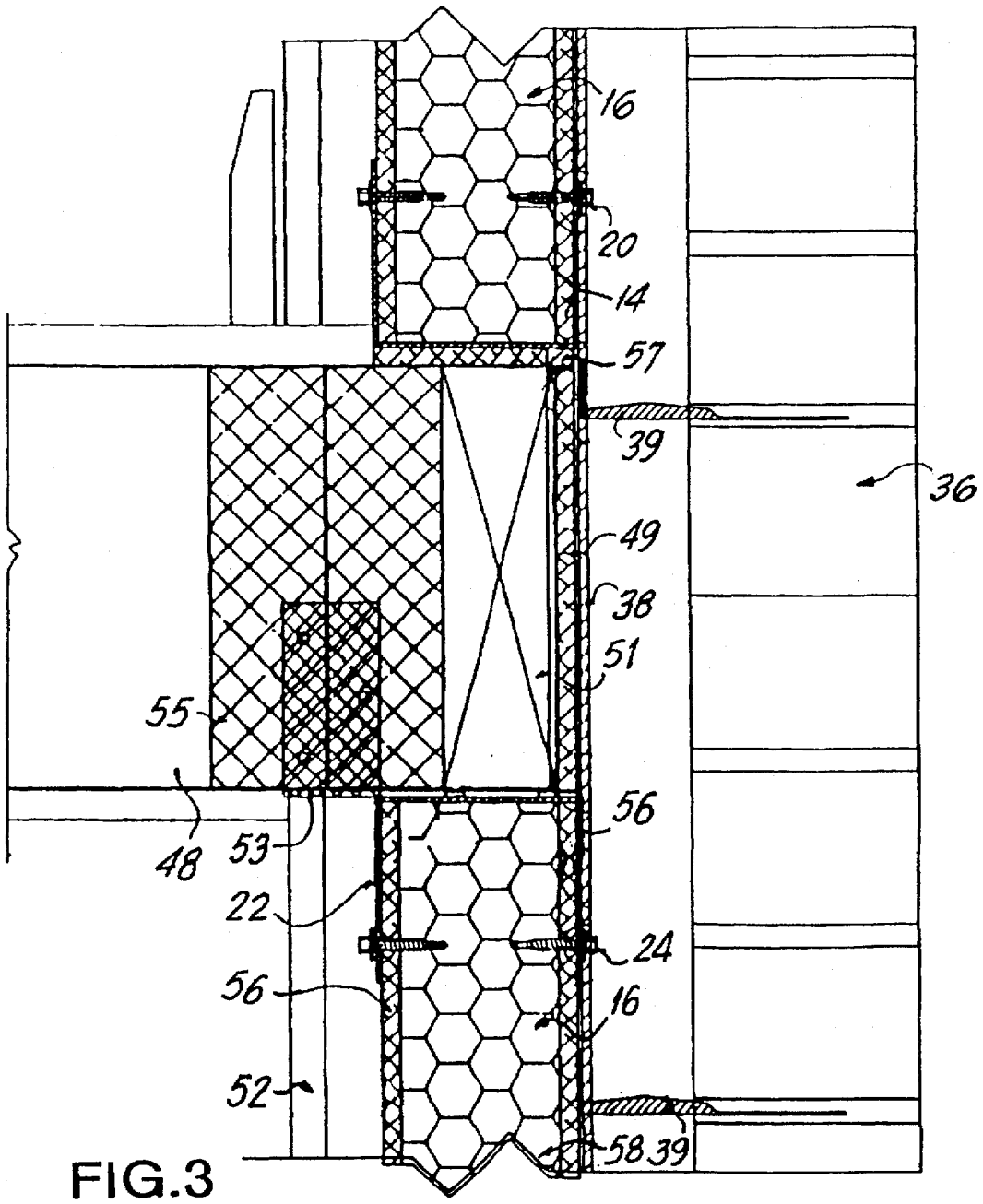
FIG. 3 is a vertical sectional view of the floor/ceiling of a multi-story building.
Figure 5:
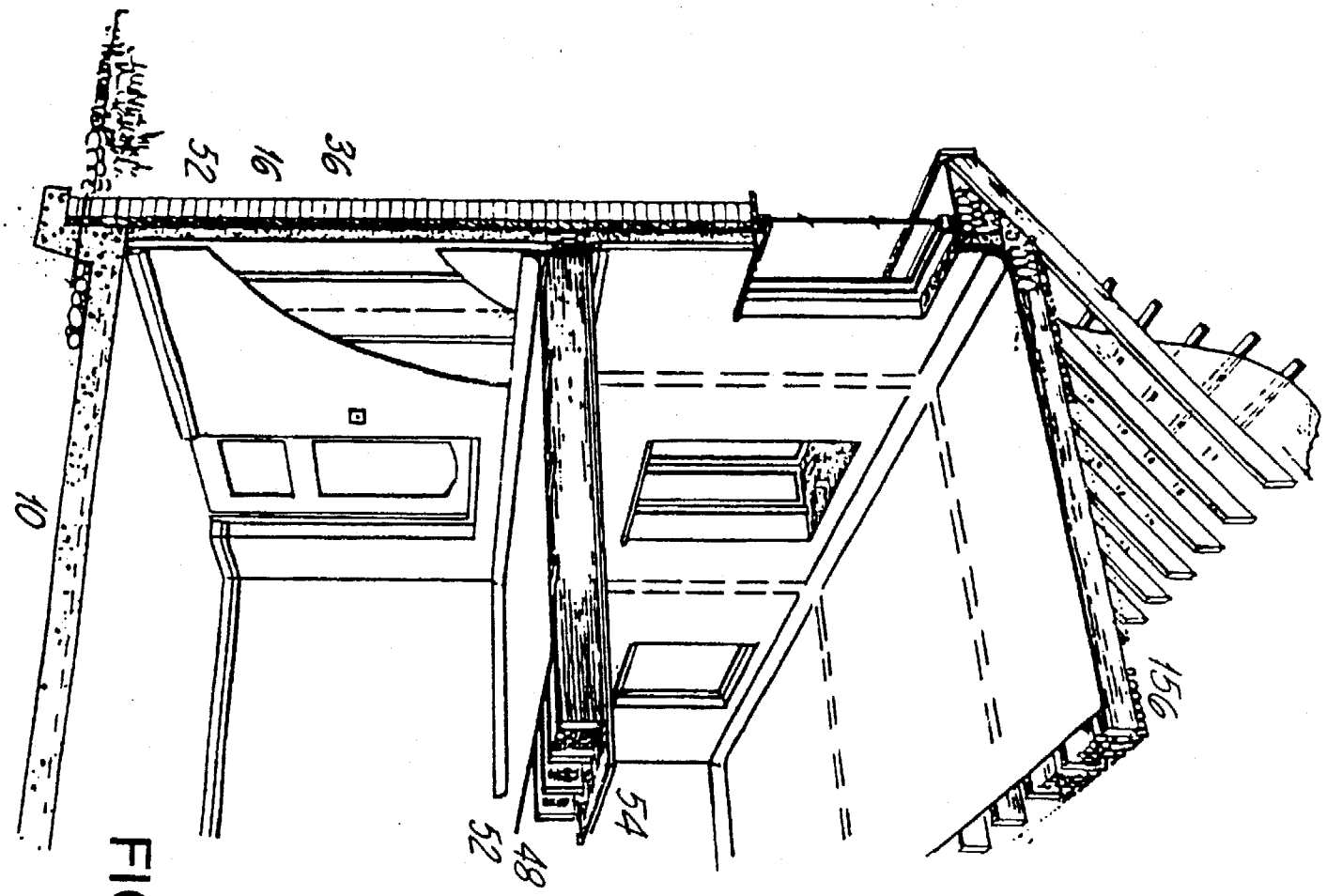
FIG. 5 is a broken-away perspective view of a multi-story building.

The building shown in FIG. 1 is a single-story but the present invention is not limited to single-story buildings and multi-story buildings may be constructed, as shown in FIG. 5, which is a broken-away view through a wall of a multi-storey building. The ground floor of a multi-story building is formed in the same way as described above in connection with FIG. 1, except that, instead of the roof, a timber cassette floor or concrete floor (which may either be precast or cast in situ) or pressed metal floor is laid on top of the round floor panel. As shown in FIG. 3, a strip of cement particle board 49 is placed on the outside of the floor cavity above the ground floor panel and the floor includes timber joists 48 supported on the panel of the ground floor; the ends of the joists abut the strip 49; noggins of wood 51 are secured between adjacent joists, while the joists themselves are secured to the panels using known joist straps 53. The reference number 55 indicates insulation. To construct the second story, channels 14 are then secured to the joists 48 and noggins 51, optionally with packing 57 provided to ensure that the channels 14 are level. The second story is constructed in the same way as the first story.

Plasterboard 52 can be secured to the joists 48 to form the ceiling of the first storey and, if required, standard flooring tongue-and-groove boards 54 can be secured to the joists to finish the floor of the second storey.

A top plate channel 22 is secured on the top of the panel 16 of the second storey (assuming that the building is of two storeys) and trussed rafters 156 may be secured to the panels 16 using standard building techniques (see FIG. 5).

The internal walls of the building are provided with plasterboard 52 not only to improve its appearance but also to provide protection against fire, as described below.

Figure 6:
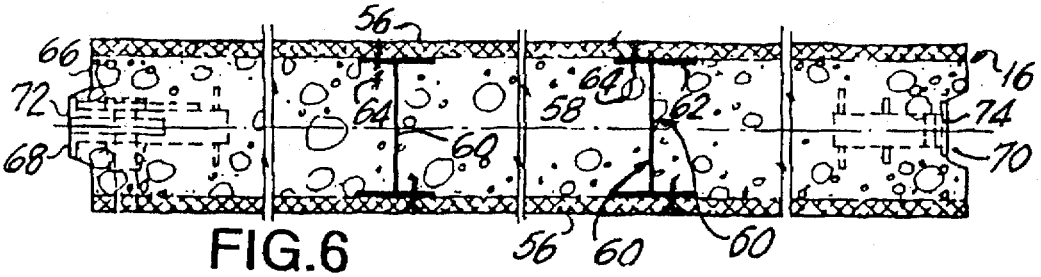
FIG. 6 is a horizontal sectional view through a panel.

Referring to FIG. 6, there is shown a horizontal section through a panel 16. As shown, the panel is made of two skins 56 of cement particle board (for example 8 mm thick Viroc cement particle board from S.B.B.C. of Morceux, France) and a layer of foamed polyurethane 58, which is 70 mm thick, sandwiched therebetween. Vertical "T" section metallic studs 60 are incorporated in the panel and extend throughout its length. Screws 64 pass through the boards 56 into the flanges of stud 60.

Figure 7:
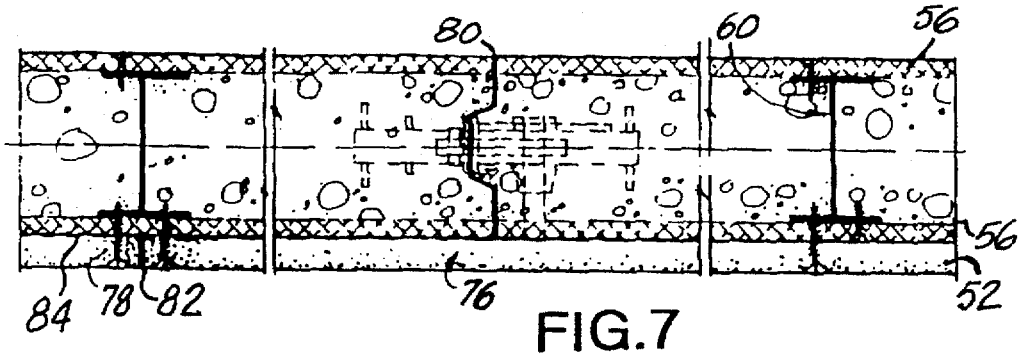
FIG. 7 is a horizontal section through part of a wall constructed from panels.

As can be seen in FIGS. 6 and 7, one side 66 of each panel is formed as a male edge with a projection 68 that can fit into a recess 70 of an adjacent panel. Also included in the side 66 of the panel is a lock 72 that can engage a rebate 74 in the recess 70 of an adjacent panel to hold adjacent panels together. The lock and rebate 72, 74 will be described in greater detail below.

The panels may be formed as follows, one face sheet of cement particle board is loaded into a jig having a base and four short walls. Studs are placed on top of the face sheet in their final intended locations, and locks and rebates 72 and 74 for the panel are held by the jig walls in their final locations. The jig is mounted on the base of a press, e.g. an oyster press, and a further face sheet is placed in the top of the press. Precursors for an polyurethane foam e.g. Elastopar UK H 1326/5 supplied by Elastogram U.K. Limited, of Somercotes, Derby, United Kingdom, are mixed and sprayed into the jig. Before the precursors have completely foamed, the press is closed and the panel is cured for approximately ten minutes (it will be appreciated that the walls of the jig retain the foam in the space between the face sheets). After curing, the panel is removed from the jig and the face sheets are secured to the studs by means of self-tapping fasteners 64 driven through the face sheets into the studs.

The sandwich construction of the panels 16 provides highly efficient thermal insulation.

Figure 9:
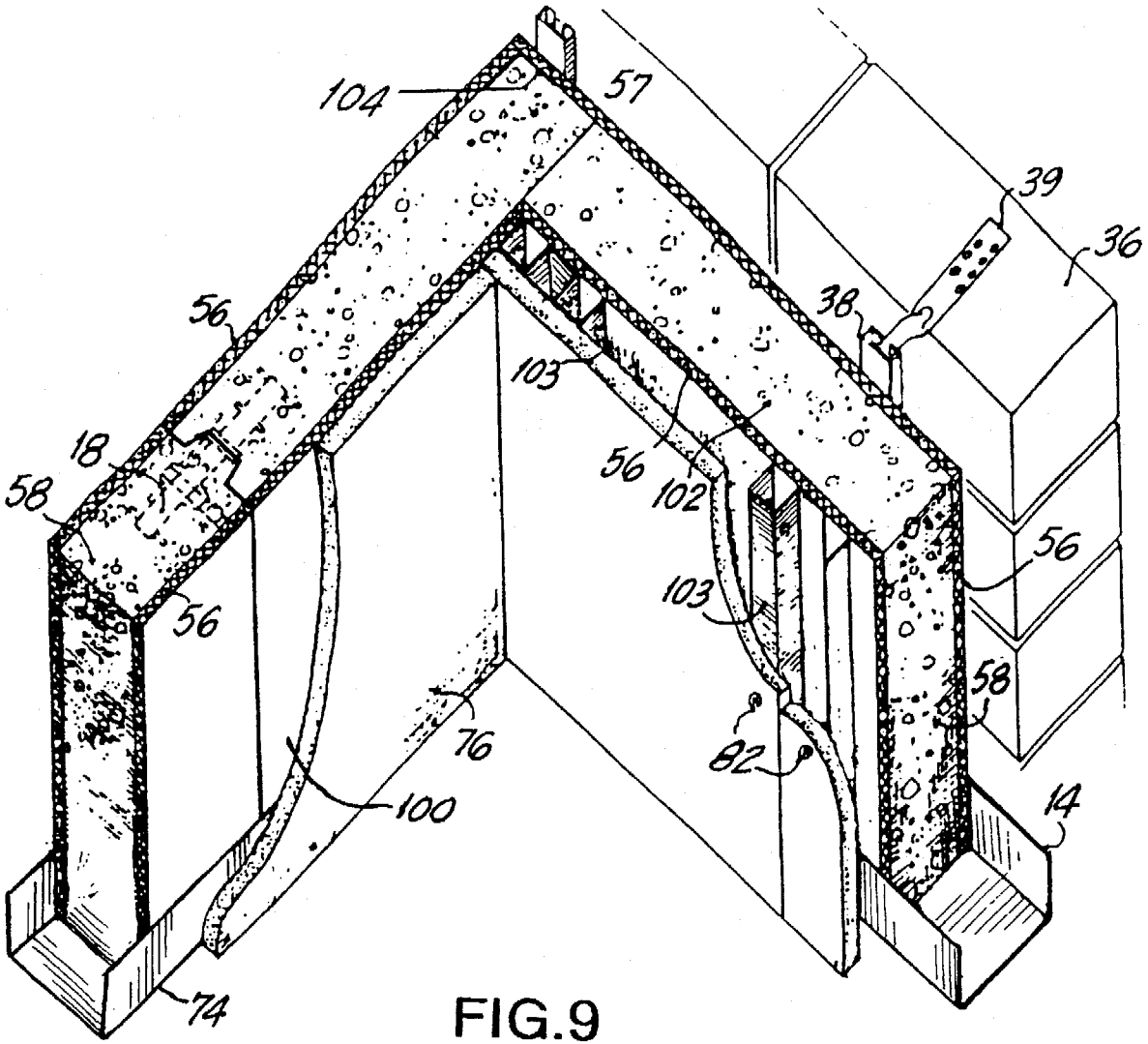
FIG. 9 is a horizontal sectional perspective view at the corner of a building.

Referring to FIG. 7, there are shown two adjacent panels 16 secured together by means of a lock and rebate system 72, 74. Plasterboard, for example fire-resistant plasterboard 52, such as Redland Firecheck (obtainable from Redland Plasterboard Limited of Horsham, Susex, U.K.) is secured to the panels by means of screws 78 that are held by flanges 62 of studs 60 as shown in the left-hand section of FIG. 7. The plasterboard 52 covers the joint 80 between adjacent panels and not only masks this joint but also prevents the edges of the panels 16 being exposed to heat through the joint 80-in the event of fire. In order to assist in the prevention of the effects of a fire within a building from acting through the joint 82 between adjacent sections of plasterboard vapour barrier 84 is provided underneath the plasterboard 52, particularly in the area of the joint 82. The joint 82 between sections of plasterboard and joint 80 between panels should never coincide since that would detract from the fire resistance of the building. The plasterboard need not abut the panels 16 but may be spaced apart, as shown in FIG. 9, where service ducts 103 are located between the plasterboard 52 and the panel 16 for electricity cables, telephone lines, sewer pipes and/or gas pipes.

Figure 8A:
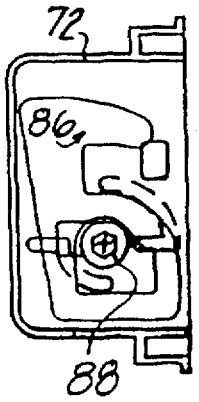
PRIOR ART FIG.8a
FIGS. 8*a*–8*c* are sectional views through a lock for securing adjacent panels together, FIGS. 8*a* and 8*b* showing the two parts of the lock separated and FIG. 8*c* showing the two parts secured together.
Figure 8B:
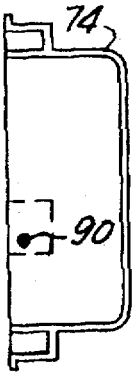
PRIOR ART FIG.8b
Figure 8C:
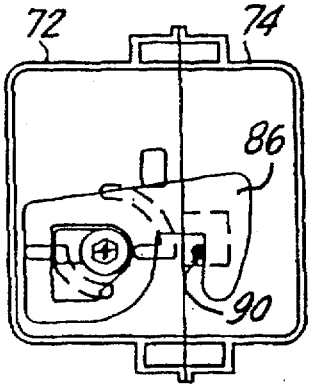
PRIOR ART FIG.8c

FIG. 8 shows a lock 72 and a rebate 74 used for securing adjacent panels together. The lock 72 includes a pivotable hook 86 that can be turned by an allen key inserted into hexagonal hole 88. The rebate 74 includes a pin 90 that can be engaged by the hook 86 to hold the adjacent panels together. FIG. **8*b* shows the arrangement when the lock 72 is engaged with the rebate 74. The cam lock is so arranged that, once the hook 86 is engaged on the pin 90** turning of the allen key will draw the panels together.

Corners between walls may be formed by separate corner panels each having flat, i.e. unprofiled, edges and with a strip of particle board 56 being removed along the internal face of one panel 100 (see FIG. 9) forming the corner and a strip 57 of particle board extending beyond the edge of the other panel 102 so that the two panels can be arranged at right angles to each other with the particle board 56 on each panel abutting as shown. The two panels are secured together by right-angle brackets 104 which may be pushed between the foam and the particle board of each panel (or fixed externally) and secured using screws (not shown) passing through the particle board 56 into the bracket 104.

A detail of a window is shown in FIG. 4: an opening is created between panels 32 and 30 forming the base and the top (respectively) of the opening and panels 26 and 28 (see FIG. 1), forming the sides of the opening. U-shaped brackets 200 are pushed into the exposed edges of the panels between the particle board and the foam and secured in place by screws 202. Plasterboard strips 33 are secured to the top and the sides of the opening with the strips spanning the thickness of the opening; a window sill 206 is secured to cover the bottom of the opening. L-shaped brackets 208 are secured to the panels around the outside of the opening and a wooden window frame 34 is secured to the brackets: a double glazed window 212 is fitted in the frame. Alternatively, the window (or door) frame may be fixed directly to the "U"-shaped bracket 200.

A lintel 222 extends between the top panel 30 and the opening in the brick facing 36. Weatherproof strip 210 is placed around the frame to provide a waterproof seal between the window frame 34 and the brick facing 36. Cavity barriers 214 are included between the panels and the brick facing to seal the cavity therebetween. Finally, a curtain rail 216 is secured above the window.

EXAMPLE

A fire test was performed in accordance with British Standard 476: Part 21:1987, Section 8, on a specimen consisting of three panels of the present invention joined together with cam locks as depicted in FIG. 8. Each panel consisted of two 8 mm thick Viroc cement particle boards containing a polyurethane foam filling 70 mm thick and two mild steel I-section studs extending from the top to the bottom surface of the panels and being secured to the face sheets with screws. The panels were covered on one side with 15 mm thick Redland Firecheck plasterboard incorporating a vapor barrier fastened to the particle board of that panel.

The sample was subjected to a 10 kN/m compressive load applied vertically by six hydraulic rams and spread over the length of the sample by steel channelling.

The sample formed one wall of a furnace (the plasterboard facing into the furnace) and the furnace was heated in accordance with the British Standard, reaching 680° C. after 10 minutes, 780° C. after 20 minutes. 840° C. after 30 minutes and 970° C. after 70 minutes.

The test was discontinued after 75 minutes; throughout that time the panels withstood the 10 kN/m load. After 73 minutes flaming occurred on the unexposed surface the wall, emanating from a joint and the thermal insulation of the panel was maintained for 73 minutes.

We claim:

1. A rectilinear composite load-bearing building panel for building structural load-bearing walls of permanent buildings, having a pair of opposed faces, a top surface, a pair of opposed sides and a bottom surface, the panel comprising a pair of spaced-apart rigid face boards of thermally non-conductive, fire resistant material, a rigid insulating material sandwiched between, and adhering to the face boards to form a composite structure capable of withstanding compressive forces between the top surface and the bottom surface of at least 5 kN per meter length of the panel, connecting means secured to the pair of the face boards and connecting the face boards together to resist relative movement between the face boards in the plane of the panel and out of the plane of the panel and wherein the opposed sides each have a profiled shape for mating with a correspondingly profiled side of an adjacent panel and wherein the sides have securing means for securing them to sides of adjacent panels.

2. A panel as claimed in claim 1, wherein the face boards are selected from the group consisting of particle boards, cement particle boards, glass fiber reinforced cement boards, cellulose reinforced gypsum boards, crushed slate boards and resin boards.

3. A panel as claimed in claim 1, wherein the insulating material is an organic foam.

4. A panel as claimed in claim 3, wherein the foam is a polyurethane.

5. A panel as claimed in claim 3, wherein the foam is formed in situ between the face boards and materials used are such that the foam adheres directly to a face board.

6. A panel as claimed in claim 3, wherein the face boards are cement particle boards and the foam is a polyurethane foam.

7. A panel as claimed in claim 1, wherein the connecting means is an elongate member extending vertically in the panel and is secured to the face boards.

8. A panel as claimed in claim 1, wherein the connecting means are spaced inwardly of the opposed sides.

9. A panel as claimed in claim 1, wherein the connecting means is a stud extending through the panel.

10. A panel as claimed in claim 1, wherein the connecting means is spaced inwardly of the securing means and wherein the securing means is not secured to the connecting means.

11. A permanent building comprising a foundation, a plurality of walls enclosing a space within the building, the walls being formed at least partially from panels as claimed in claim 1 whose opposed sides are secured together, means secured to the foundation for holding bases of the panels, means for holding tops of the panels and a roof structure supported on the walls, wherein the walls made of said panels form at least part of a structural frame of the building.

12. A building as claimed in claim 11, which is single storey.

13. A building as claimed in claim 11, which is multistorey and wherein each storey is formed by a row of panels as claimed in claim 16.

14. A building as claimed in claim 11, wherein internal walls of the panels are clad with a fire-resistant material.

15. A kit for forming a building, the kit comprising a plurality of panels as defined in claim 1 that can be secured together to form walls, means for securing to the foundation of a building for holding a base of each of the panels, means for holding tops of the panels and a roof structure.

16. A rectilinear composite load-bearing building panel for building structural load-bearing walls of permanent buildings, having a pair of opposed faces, a top surface, a pair of opposed sides and a bottom surface, the panel comprising a pair of spaced-apart rigid face boards of thermally non-conductive, fire resistant material, a rigid insulating material sandwiched between, and adhering to the face boards to form a composite structure capable of withstanding compressive forces between the top surface and the bottom surface of at least 5 kN per meter length of the panel, an elongated member extending through the panel and having a pair of opposed flanges, wherein the opposed flanges are secured to the pair of face boards to resist relative movement between the face boards in the plane of the panel and out of the plane of the panel and wherein the opposed sides each have a profiled shape for mating with a correspondingly profiled side of an adjacent panel and wherein the sides have securing means for securing them to sides of adjacent panels.

* * * * *